US006784843B2

(12) United States Patent
Onaka et al.

(10) Patent No.: US 6,784,843 B2
(45) Date of Patent: Aug. 31, 2004

(54) MULTI-RESONANCE ANTENNA

(75) Inventors: Kengo Onaka, Yokohama (JP); Shoji Nagumo, Kawasaki (JP); Takashi Ishihara, Machida (JP); Jin Sato, Sagamihara (JP); Akira Miyata, Yokohama (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 133 days.

(21) Appl. No.: 10/257,878

(22) PCT Filed: Feb. 18, 2001

(86) PCT No.: PCT/JP02/01367

§ 371 (c)(1),
(2), (4) Date: Oct. 17, 2002

(87) PCT Pub. No.: WO02/067371

PCT Pub. Date: Aug. 29, 2002

(65) Prior Publication Data

US 2004/0027287 A1 Feb. 12, 2004

(30) Foreign Application Priority Data

Feb. 22, 2000 (JP) ..... 2001-046956

(51) Int. Cl.[7] ..... H01Q 1/38; H01Q 1/24

(52) U.S. Cl. ..... 343/700 MS; 343/702

(58) Field of Search ..... 343/700 MS, 702, 343/846, 848, 873; H01Q 1/38, 1/24

(56) References Cited

U.S. PATENT DOCUMENTS 6,437,744 B1 * 8/2002 Akiyama et al. .... 343/700 MS
6,677,902 B2 * 1/2004 Akiyama et al. .... 343/700 MS

FOREIGN PATENT DOCUMENTS

| | | |
|---|---|---|
| JP | 5-347509 | 12/1993 |
| JP | 5-347510 | 12/1993 |
| JP | 2001-007639 | 1/2001 |

* cited by examiner

*Primary Examiner*—Hoanganh Le
(74) *Attorney, Agent, or Firm*—Keating & Bennett, LLP

(57) ABSTRACT

In a multi-resonance antenna, at an open end of a radiation electrode of a feeding element and an open end of a radiation electrode of a parasitic element capacitance loading electrodes and ground electrodes are arranged opposite to each other. In the opposing portions, electric-field deflectors are provided, thus reducing the electric-field coupling between the feeding element and the parasitic element.

15 Claims, 10 Drawing Sheets

Fig.6A
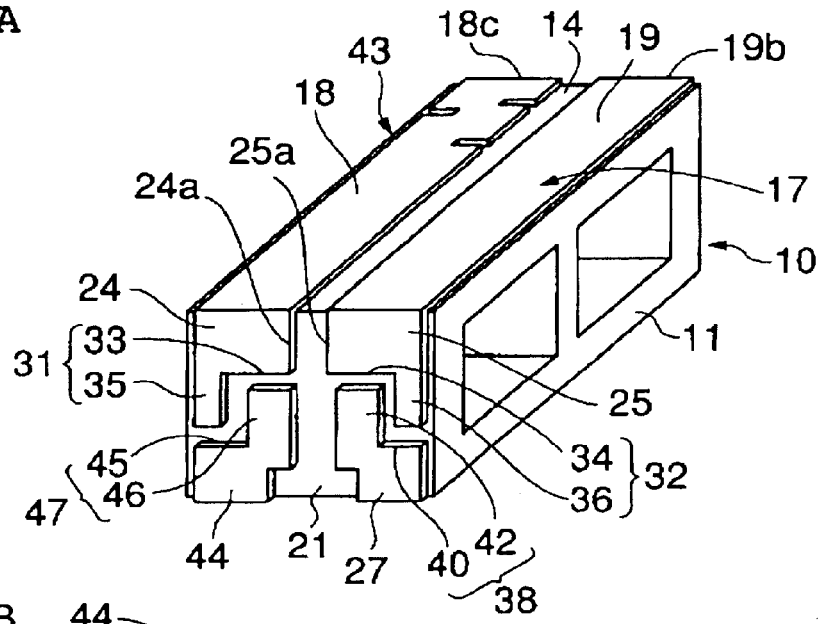
Fig.6B
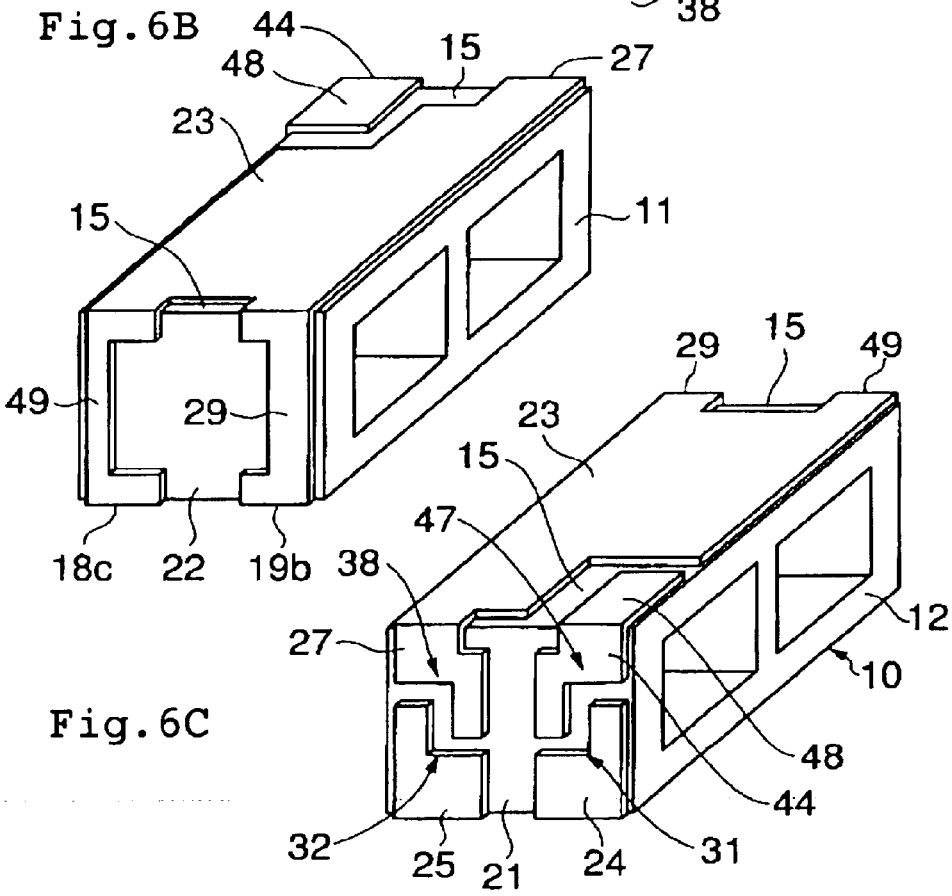
Fig.6C

MULTI-RESONANCE ANTENNA

TECHNICAL FIELD

The present invention relates to multi-resonance antennas, and more particularly, relates to a broadband multi-resonance antenna suitable for a portable information terminal.

BACKGROUND ART

Recently, there has been a demand for linking information terminals such as cellular phones, portable mobile terminals, and stationary terminals having communication functions with one another by wireless communication using the high frequency 1 to 5 GHz band. One example of such a communication method uses a center frequency of 2.45 GHz and a bandwidth of approximately 100 MHz. The method wirelessly links nearby information terminals. Data signals, audio signals, and video signals can be transmitted and received in bulk.

Wireless transceivers incorporated into or added to these information terminals are required to be miniaturized as much as possible. Concerning antennas mounted on the wireless transceivers, so-called miniature surface-mounted antennas which are miniaturized as much as possible are required.

The electrical length of an antenna is determined by the frequency of the operating electromagnetic waves. In order to ensure satisfactory antenna characteristics using a small antenna, it is necessary to form a radiation electrode on a dielectric base member with a high relative dielectric constant. The size of the antenna is generally determined by the relative dielectric constant and the volume of the base member. In an antenna using a dielectric base member with a high relative dielectric constant, the radiation electrode can be shortened relative to the operating frequency. Accordingly, the electrical Q factor is improved, whereas the effective frequency band is narrowed.

In order to broaden the frequency band, there is a broadband linear antenna described in Japanese Unexamined Patent Application Publication No. 6-69715.

As shown in FIG. 12, the antenna contains a feeding element 3 on the top surface of a circuit board 1 formed of polyimide. The feeding element 3 is a radiation electrode strip with a power feeder 2. The antenna also contains a parasitic element 5 which differs in length from the feeding element 3. The parasitic element 5 is a radiation electrode strip with a ground 4 at one end thereof. The feeding element 3 and the parasitic element 5 are arranged side-by-side in parallel to each other. In the antenna, electric-field coupling is established between the feeding element 3 and the parasitic element 5, and the feeding element 3 feeds power to the parasitic element 5, thus causing the feeding element 3 and the parasitic element 5 to resonate at multiple frequencies. As a result, a broad frequency band is achieved.

Regarding the foregoing antenna arranged as described above, the length of the radiation electrode of the feeding element 3 is limited to approximately 410 mm, and the length of the radiation electrode of the parasitic element 5 is limited to approximately 360 mm. It is thus difficult to configure a portable and miniature antenna. The antenna is not configured to adjust multi-resonance matching between the feeding element 3 and the parasitic element 5.

In other words, in the foregoing antenna, it is difficult to form a plurality of radiation electrodes on the surface of a dielectric base member with a small volume so as to satisfy the conditions for optimal multi-resonance matching. Specifically, when the radiation electrode of the feeding element and the radiation electrode of the parasitic element are arranged on the same principal surface of the dielectric base member, the distance between the feeding element and the parasitic element becomes narrow. Thus, excessive electric-field coupling occurs. As shown in FIG. 13, a resonance frequency f1 of the feeding element and a resonance frequency f2 of the parasitic element are separated from each other, and hence the feeding element and the parasitic element do not resonate at multiple frequencies. When the radiation electrodes are shortened to force multi-resonance to occur, as shown in FIG. 14, satisfactory matching cannot be achieved in resonance at one side. Thus, the antenna is in a single resonance state at the resonance frequency f1, and the optimal multi-resonance matching cannot be achieved.

In order to achieve multi-resonance matching, the electric-field coupling between the feeding element and the parasitic element is required to be weakened. When the principal surface of the dielectric base member is widened, the size of the base member itself is increased. It is thus impossible to obtain a miniaturized surface-mounted antenna. When the width of each radiation electrode is reduced too much, inductance components vary widely, and the resonance characteristics become unstable. It is thus difficult to mass-produce the antenna. Alternatively, the radiation electrode of the feeding element and the radiation electrode of the parasitic element can be arranged on the principal surface and an end surface of the dielectric base member, respectively. When the distance between the feeding element and the parasitic element becomes too large, satisfactory electric-field coupling cannot be achieved. When screen-printing the radiation electrodes, it is necessary to print two sides, namely, the principal surface and the end surface. Thus, the number of printing steps is increased, and the manufacturing cost is increased.

DISCLOSURE OF INVENTION

In order to solve the foregoing problems, it is an object of the present invention to provide a multi-resonance between a feeding element and a parasitic element by suppressing excessive electric-field coupling between the feeding element and the parasitic element.

In order to achieve the foregoing object, the present invention solves the problems using the following arrangement. Specifically, a multi-resonance antenna of the present invention includes a feeding element including a first radiation electrode and a feeding electrode for feeding power to the first radiation electrode; a parasitic element including a second radiation electrode arranged next to the first radiation electrode; a ground electrode arranged opposite to an open end of each of at least one of the first radiation electrode and the second radiation electrode with a predetermined gap therebetween; and an electric-field deflector for suppressing electric-field coupling between the feeding element and the parasitic element, the electric-field deflector being formed in a portion where each open end and each ground electrode are opposed to each other.

According to the present invention, the electric-field deflector (s) is provided in one or both of portions where each open end of the feeding element and the parasitic element and each ground electrode are opposed to each other. Thus, the electric field is concentrated at the opposing portion between the open end and the ground electrode, and the electric-field coupling between the open end and the ground electrode is strengthened. In contrast, the electric-field coupling in the vicinity of the open ends of the feeding element and the parasitic element is weakened. Thus, the electric-field coupling between the feeding element and the parasitic element can be optimally adjusted, and satisfactory multi-resonance of the feeding element and the parasitic element can be caused to occur.

In other words, the electric field leaking from the vicinity of the open ends of the feeding element and the parasitic element where the electric field becomes the strongest is reduced, thus weakening the electric-field coupling between the feeding element and the parasitic element. As a result, the feeding element and the parasitic element can be caused to satisfactorily resonate at multiple frequencies.

In the multi-resonance antenna of the present invention, the first radiation electrode and the second radiation electrode may be radiation electrode strips which are arranged approximately parallel to each other. Preferably, the electric-field deflector substantially encloses the electric field generated between the open end and the ground electrode in between the open end and the ground electrode and deflects the direction of an electric field vector from the direction in which the first radiation electrode and the second radiation electrode extend.

The open end of the radiation electrode and the ground electrode may have opposing edges which are not perpendicular to the direction in which the first radiation electrode and the second radiation electrode extend. In other words, it is preferable that the electric-field deflector have an opposing edge for deflecting the direction of the electric field from the direction in which the feeding element and the parasitic element extend. Arranged as described above, part or the entirety of both opposing edges of the open end and the ground electrode are parallel to or tilted relative to the direction in which the feeding element and the parasitic element extend. Thus, the direction of the electric field generated between the open end of the radiation electrode and the ground electrode is changed. The electric field leaking from the opposing portion between the open end of the radiation electrode and the ground electrode is reduced compared with a case in which the opposing edges of the open end of the radiation electrode and the ground electrode are simply horizontal.

In the multi-resonance antenna of the present invention, a capacitance loading electrode may be provided at the open end of the radiation electrode. Preferably, the electric-field deflector is formed by the capacitance loading electrode and the ground electrode.

First and second capacitance loading electrodes may be formed at the open end of the first radiation electrode and the open end of the second radiation electrode, respectively. A first ground electrode may be formed opposite to the first capacitance loading electrode with a predetermined gap therebetween, and a second ground electrode may be formed opposite to the second capacitance loading electrode with a predetermined gap therebetween.

In this case, it is preferable that the electric-field deflectors be formed between the first capacitance loading electrode and the first ground electrode and between the second capacitance loading electrode and the second ground electrode.

Preferably, in order to miniaturize the multi-resonance antenna, the first radiation electrode and the second radiation electrode are formed to be strip-shaped and parallel to each other on a first principal surface of a substantially-rectangular dielectric base member, and the first capacitance loading electrode and the second capacitance loading electrode are formed on an end surface adjacent to the first principal surface of the dielectric base member.

In this case, the first ground electrode and the second ground electrode may be formed on the end surface of the dielectric base member, and the electric-field deflectors may be similarly formed on the end surface.

According to the present invention, there is provided a multi-resonance antenna including a dielectric base member; a first radiation electrode and a second radiation electrode which are strips formed in parallel to each other on a principal surface of the dielectric base member; a feeding electrode for feeding power to the first radiation electrode; an earth electrode for grounding the second radiation electrode; first and second capacitance loading electrodes formed at open ends of the first and second radiation electrodes, respectively; a ground electrode arranged opposite to each of at least one of the first and second capacitance loading electrodes. The capacitance loading electrode and the ground electrode are provided with protruding electrodes which extend in the opposite directions in a portion where the capacitance loading electrode and the ground electrode are opposed to each other.

According to the multi-resonance antenna, the protruding electrodes are formed opposite to each other in the opposing portion between the capacitance loading electrode and the ground electrode. Thus, electric lines of force leaking from the opposing portion between the capacitance loading electrode and the ground electrode can be reduced. As a result, mutual interference in the adjacent capacitance loading electrode by the electric lines of force from the opposite side is weakened.

In other words, the opposing edges of the capacitance loading electrode and the ground electrode become longer, and the electric lines of force are concentrated at the opposing portion. Also, the direction of electric lines of force in the opposing portion between the capacitance loading electrode and the ground electrode is changed, and mutual interference in electric lines of force between the adjacent feeding element and the parasitic element is weakened. As a result, multi-resonance matching between the feeding element and the parasitic element can be achieved.

In the multi-resonance antenna, it is preferable that the protruding electrode of the capacitance loading electrode and the protruding electrode of the ground electrode have opposing edges which extend in a direction differing from the direction in which the plurality of capacitance loading electrodes are aligned.

With this electrode arrangement, electric lines of force in the opposing portion between the capacitance loading electrode and the ground electrode are aligned in the same direction as the direction in which the opposing edges are arranged. The distribution density of electric lines of force becomes maximum in the opposing edges. Thus, the electric-field coupling with the adjacent radiation electrode is greatly weakened, and it is possible to make sufficient adjustments in order to cause satisfactory multi-resonance to occur.

BRIEF DESCRIPTION OF THE DRAWINGS

FIGS. 1A and 1B show a multi-resonance antenna according to a first embodiment of the present invention, wherein FIG. 1A is a perspective view of a front surface, and FIG. 1B is a perspective view of a back surface;

FIGS. 6A to 6C show a multi-resonance antenna according to a second embodiment of the present invention, wherein FIG. 6A is a perspective view of a front surface, FIG. 6B is a perspective view of a back surface observed from a ground electrode side, and FIG. 6C is a perspective view of the back surface observed from a feeding electrode side;

BEST MODE FOR CARRYING OUT THE INVENTION

Hereinafter, a multi-resonance antenna according to the present invention is described using embodiments.

First Embodiment

Figure 1A:
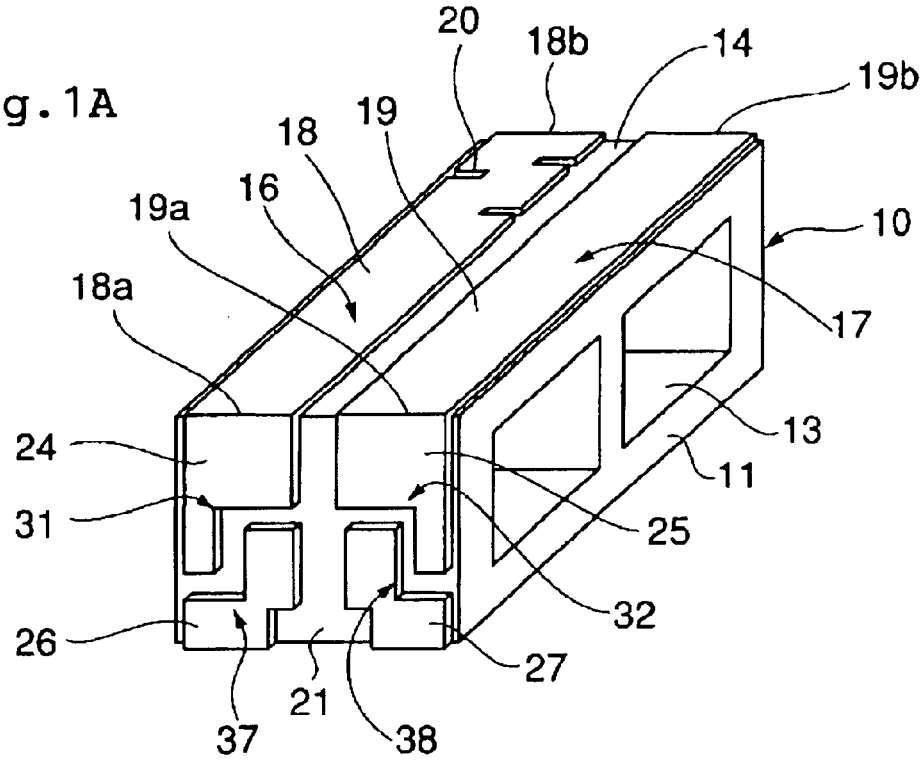
Figure 1B:
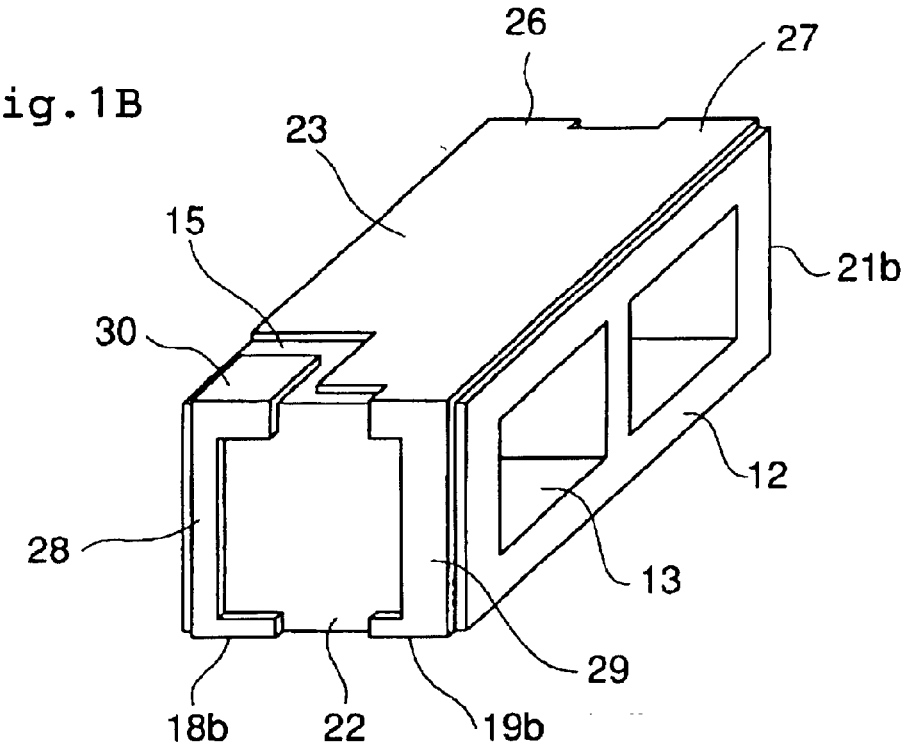

FIGS. 1A and 1B show a multi-resonance antenna according to a first embodiment of the present invention. FIG. 1A shows the multi-resonance antenna observed from a front surface side, and FIG. 1B shows the multi-resonance antenna observed from a back surface side.

Referring to FIGS. 1A and 1B, a dielectric base member 10 is a rectangular parallelepiped and is formed of ceramic with a high relative dielectric constant. Transverse end surfaces 11 and 12 of the dielectric base member 10 contain through holes 13 penetrating through the end surface 11 and the end surface 12. Thus, the weight and the cost of the dielectric base member 10 are reduced.

The dielectric base member 10 is provided with a feeding element 16 and a parasitic element 17 on which electrodes are formed, which will be described below. Specifically, a first radiation electrode 18 and a second radiation electrode 19, both of which are in the shape of a strip, are formed on a first principal surface (top surface) 14 of the dielectric base member 10. The first radiation electrode 18 and the second radiation electrode 19 are formed with a predetermined distance therebetween and are substantially parallel to each other. The necessary number of slits 20 is provided on the surface of the first radiation electrode 18 forming the feeding element 16. The effective electrical length of the feeding element 16 is adjusted by the slits 20. A ground conductor layer 23 is formed on substantially the entirety of a second principal surface (bottom surface) 15 of the dielectric base member 10 excluding the periphery of a feeding terminal 30 described below.

On a longitudinal end surface 21 of the dielectric base member 10 positioned an open end 18A of the first radiation electrode 18 and an open end 19A of the second radiation electrode 19, a first capacitance loading electrode 24 which is continuous with the first radiation electrode 18 and a second capacitance loading electrode 25 which is continuous with the second radiation electrode 19 are provided. On the end surface 21, a first ground electrode 26 which is formed opposite to the first capacitance loading electrode 24 with a predetermined gap therebetween and a second ground electrode 27 which is formed opposite to the second capacitance loading electrode 25 with a predetermined gap therebetween are provided. The ground electrodes 26 and 27 are connected to the ground conductor layer 23 on the bottom surface 15 of the dielectric base member 10.

On a second longitudinal end surface 22 of the dielectric base member 10, a feeding electrode 28 and a ground electrode 29 are provided. A feeding end 18B of the first radiation electrode 18 is connected through the feeding electrode 28 to the feeding terminal 30 which is provided on the bottom surface 15 of the dielectric base member 10. A ground end 19B of the second radiation electrode 19 is connected through the ground electrode 29 to the ground conductor layer 23. Arranged as described above, the feeding terminal 30 is connected, preferably through an impedance matching circuit, to a signal source formed on a circuit board of an information terminal (not shown), such as to a wireless transmitting/receiving circuit. The ground conductor layer 23 is connected to a ground pattern of the circuit board.

According to the multi-resonance antenna of the first embodiment, the feeding element 16 and the parasitic element 17 have features in portions where the first capacitance loading electrode 24, the second capacitance loading electrode 25, the first ground electrode 26, and the second ground electrode 27, all of which are formed on the end surface 21 of the dielectric base member 20, are opposed to the corresponding electrode. These features will now be described using an enlarged view shown in FIG. 2.

A first capacitance loading stepped-portion 31 is provided at the bottom of the first capacitance loading electrode 24. A second capacitance loading stepped-portion 32 is provided at the bottom of the second capacitance loading electrode 25. These capacitance loading stepped-portions 31 and 32 contain flat edge portions 33 and 34 and extending portions 35 and 36. The flat edge portions 33 and 34 extend in the horizontal direction so as to be separated from side edges (inner edges) 24A and 25A of the capacitance loading electrodes 24 and 25, respectively. The extending portions 35 and 36 are formed by extending outer edges 24B and 25B of the capacitance loading electrodes 24 and 25, respectively, downward.

In contrast, at the top of the first ground electrode 26 and the second ground electrode 27, a first ground stepped-portion 37 and a second ground stepped-portion 38 are provided in accordance with the shape of the first capacitance loading stepped-portion 31 and the second capacitance loading stepped-portion 32. Flat portions 39 and 40 formed by horizontal edges of the ground stepped-portions 37 and 38 are opposed to leading edges of the extending portions 35 and 36, respectively. Protruding portions 41 and 42 forming the ground stepped-portions 37 and 38 protrude in the direction toward the flat portions 33 and 34 of the capacitance loading stepped-portions 31 and 32, respectively, and have leading edges opposed to the flat portions 33 and 34. With this electrode arrangement, the extending portions 35 and 36 of the capacitance loading stepped-portions 31 and 32 and the protruding portions 41 and 42 of the ground stepped-portions 37 and 38 have opposing edges 35A, 36A, 41A, and 42A which extend in the vertical direction.

Figure 3A:
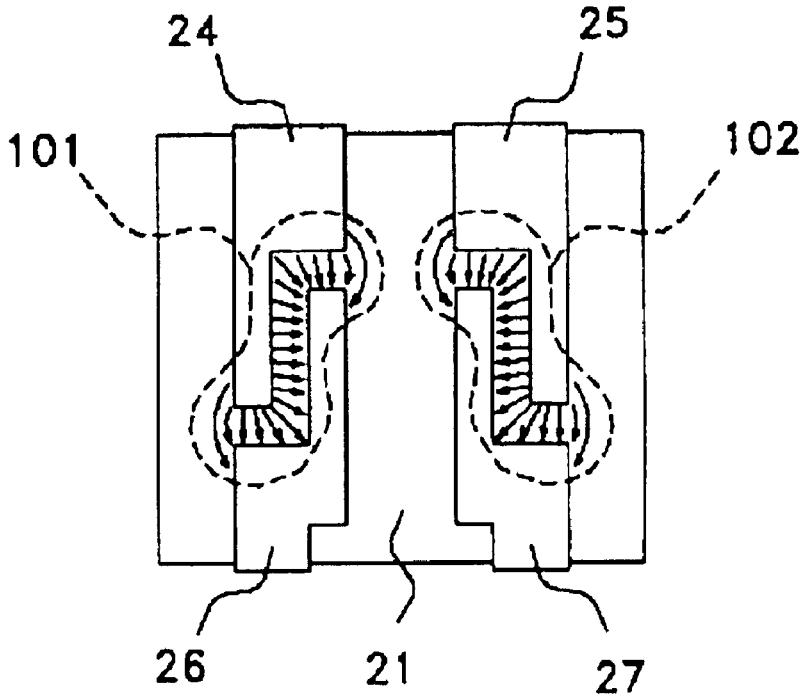
FIGS. 3A and 3B are schematic illustrations for describing electric-field deflectors in the multi-resonance antenna.

In the electrode arrangement in which the extending portions 35 and 36 and the protruding portions 41 and 42 are formed to extend in the opposite directions, when high-frequency power is supplied from the feeding electrode 28 to the feeding element 16, the electric fields in the capacitance loading electrodes 24 and 25 are concentrated at the opposing portions where the capacitance loading electrode 24 is opposed to the ground electrode 26 and the capacitance loading electrode 25 is opposed to the ground electrode 27, as indicated by the arrows in FIG. 3A. Thus, the electric field leaking from the opposing portions between the capacitance loading electrode 24 and the ground electrode 26 and between the capacitance loading electrode 25 and the ground electrode 27 is reduced. As a result, the electric-field coupling between the feeding element 16 and the parasitic element 17 is weakened in portions of the capacitance loading electrodes 24 and 25.

In other words, the directions of electric lines of force are changed in the vertical opposing edges 35A, 36A, 41A, and 42A of the extending portions 35 and 36 of the capacitance loading stepped-portions 31 and 32 and the protruding portions 41 and 42 of the ground stepped-portions 37 and 38. Accordingly, the distribution of electric lines of force changes in each opposing portion between the capacitance loading electrodes 24 and the ground electrodes 26 and between the capacitance loading electrode 25 and the ground electrodes 27. In other words, as shown in FIG. 3A, mutual interference in electric lines of force in the capacitance loading stepped-portions 31 and 32 of the adjacent feeding element 16 and the parasitic element 17 is changed.

Figure 3B:
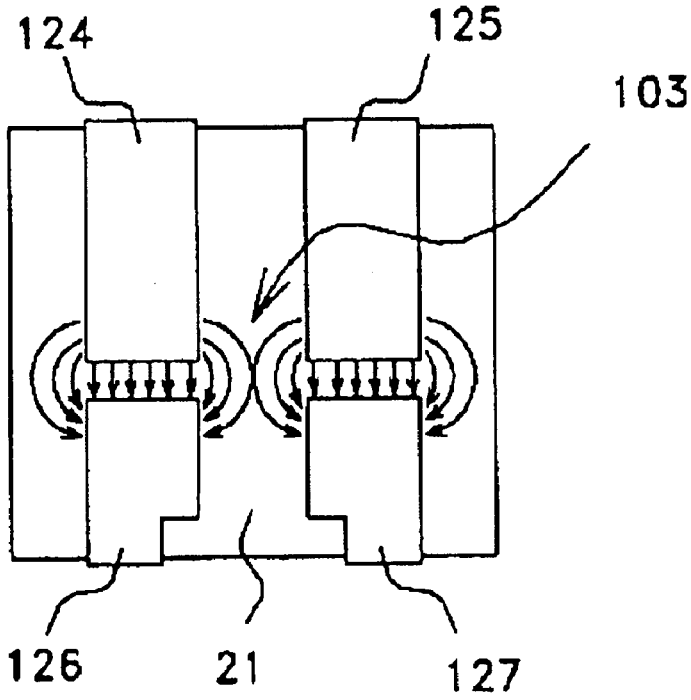

In general, the maximum distribution of the electric field is near the open ends of the feeding element and the parasitic element. When the electrodes are arranged as shown in FIG. 3B, that is, when the gap between a capacitance loading electrode 124 and a ground electrode 126 at the feeding element side and the gap between a capacitance loading electrode 125 and a ground electrode 127 at the parasitic element side are formed in the vertical direction relative to the direction in which the capacitance loading electrodes 124 and 125 extend, the electric field leaking from the portion between the capacitance loading electrode 124 and the ground electrode 126 and the electric field leaking from the portion between the capacitance loading electrode 125 and the ground electrode 127 are easily coupled with each other. Thus, When having chip-type antenna built in portable phone, the feeding element can be arranged adjacent to the parasitic element.

In contrast, as shown in FIG. 3A, according to the first embodiment, the electric fields are enclosed between the first capacitance loading electrode 24 and the first ground electrode 26 and between the second capacitance loading electrode 25 and the second ground electrode 27, and the directions of the electric field vectors are deflected. Thus, coupling is weakened, and undesired electric-field coupling between the feeding element and the parasitic element is suppressed. Accordingly, a small surface-mountable multi-resonance antenna with the optimal electric-field coupling between the feeding element and the parasitic element can be achieved.

In other words, according to the first embodiment, an "electric-field deflector" is formed in each of at least one of the portion between the open end of the first radiation electrode and the first ground electrode (that is, the portion between the first capacitance loading electrode and the first ground electrode) and the portion between the open end of the second radiation electrode and the second ground electrode (that is, the portion between the second capacitance loading electrode and the second ground electrode) and is used to deflect electric fields generated in these portions. In other words, the electric-field deflectors control the coupling between the electric field generated in the portion between the open end of the first radiation electrode and the first ground electrode and the electric field generated in the portion between the open end of the second radiation electrode and the second ground electrode. In particular, the electric-field deflectors are used to enclose the electric field and to deflect the directions of the electric-field vectors.

Figure 2:
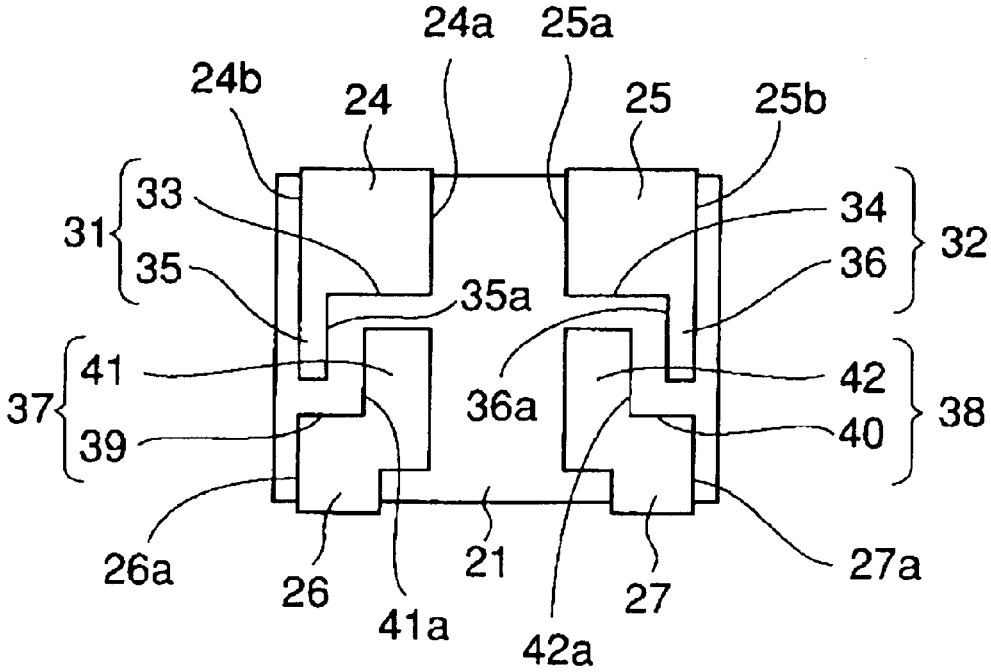
FIG. 2 is an enlarged plan view showing capacitance loading electrodes and ground electrodes in the multi-resonance antenna.

As shown in FIG. 2, the entire length of the opposing edges of the capacitance loading stepped-portions 31 and 32 and the ground stepped-portions 37 and 38 is approximately increased by the length of the vertical opposing edges 35A, 36A, 41A, and 42A of the capacitance loading stepped-portions 31 and 32 and the ground stepped-portions 37 and 38. Most of the electric lines of force pass through the opposing portions between the capacitance loading electrodes 24 and 25 and the ground electrodes 26 and 27. As a result, the electric-field coupling between the feeding element 16 and the parasitic element 17 is weakened. Thus, when the feeding element 16 and the parasitic element 17 are provided in close vicinity to each other, satisfactory multi-resonance can be achieved.

In particular, according to the multi-antenna according to the first embodiment, the sticking-out ground-side protruding portions 41 and 42 are formed at the side (inner side) where the first ground electrode 26 and the second ground electrode 27 are opposed to each other. Undesirable electric-field coupling between the feeding element 16 and the parasitic element 17 can be suppressed more efficiently.

Specific characteristics of the foregoing multi-resonance antenna will now be described.

Figure 4:
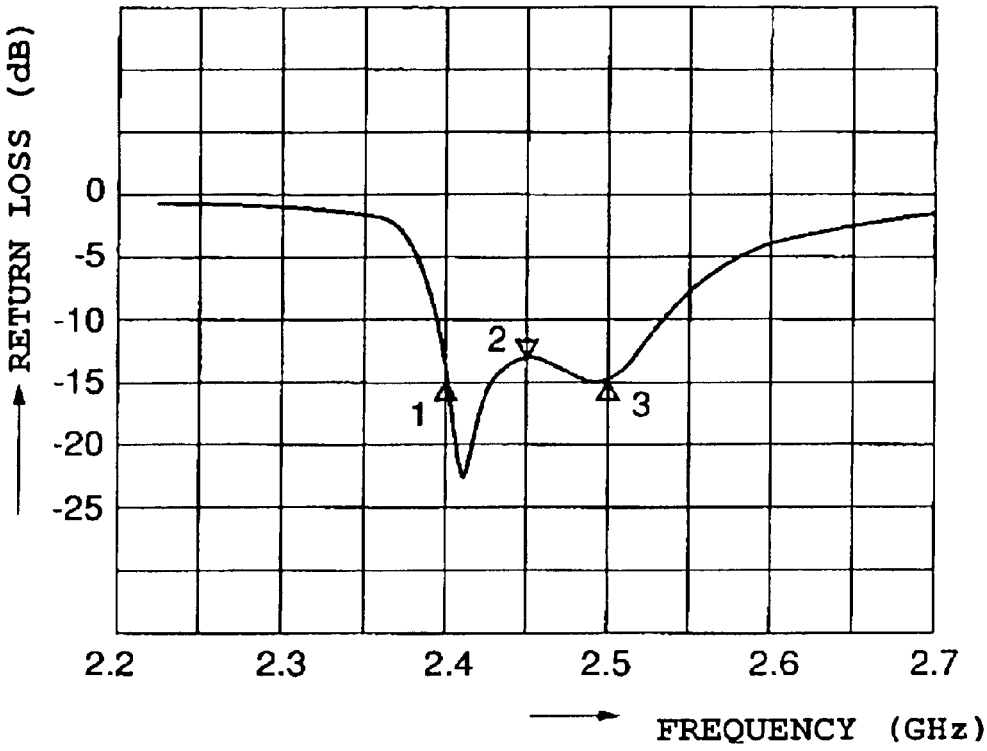
FIG. 4 shows return loss characteristics of the multi-resonance antenna according to the embodiment of the prevent invention.

The dielectric base member 10 with a length of 6 mm, a width of 6 mm, and a height of 5 mm is produced using a ceramic material with a relative dielectric constant of 6.4. On a surface of the dielectric base member 10, the feeding element 16 and the parasitic element 17 in which the electrodes are arranged as described above are formed. The first radiation electrode 18 and the second radiation electrode 19 each have a width of 2.0 mm and a length of 9.0 mm. The entire length of the first capacitance loading electrode 24 and the feeding electrode 28 and the entire length of the second capacitance loading electrode 25 and the ground electrode 29 are each 18 mm. The distance between the first radiation electrode 18 and the second radiation electrode 19 is 2.0 mm. FIG. 4 shows return loss characteristics in a case in which the horizontal axis represents frequency in this case, and FIG. 5 shows VSWR (voltage standing wave ratio) characteristics.

The return loss characteristics shown in FIG. 4 indicate a path generated by sweeping the frequency from 2.2 GHz to 2.7 GHz. Marker 1 indicates 2.4 GHz, marker 2 indicates 2.45 GHz, and marker 3 indicates 2.5 GHz. According to this characteristic curve, the resonance peaks are at the frequencies 2.41 GHz and 2.5 GHz, where the return loss is less than −10 dB. The feeding element 16 and the parasitic element 17 are in a multi-resonance matching state.

Figure 5:
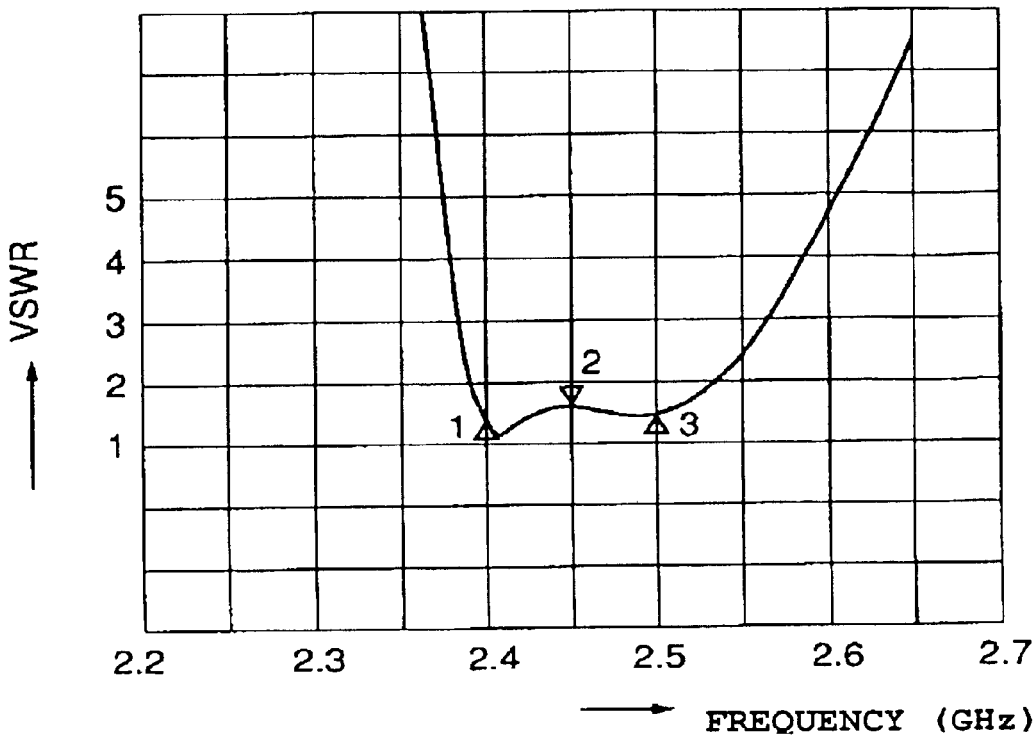
FIG. 5 shows VSWR characteristics of the multi-resonance antenna according to the embodiment of the prevent invention.

Referring to FIG. 5, markers 1, 2, and 3 indicate the same frequencies as those shown in FIG. 4. Markers 1 and 3 indicate a VSWR of 1.5, and marker 2 indicates 1.6. According to this characteristic curve, the lower limit of the frequency in which VSWR is less than or equal to 2 is 2.39 GHz, and the upper limit is 2.53 GHz. Thus, the bandwidth is approximately 138 MHz.

Second Embodiment

Referring to FIGS. 6A to 6C, a multi-resonance antenna according to a second embodiment of the present invention will now de described. The same reference numerals are given to components corresponding to those of the first embodiment shown in FIGS. 1A and 1B, and repeated descriptions of the common portions are omitted.

The multi-resonance antenna of the second embodiment differs from that of the first embodiment in that a feeding element 43 has a different electrode arrangement.

Specifically, referring to FIGS. 6A and 6B, unlike the radiation electrode shown in FIGS. 1A and 1B, the radiation electrode 18 of the feeding element 43 has a ground end 18C at the end surface 22 side of the dielectric base member 10. The radiation electrode 18 is connected to the ground conductor layer 23 through a ground electrode 49 formed on the end surface 22.

In contrast, similar to FIGS. 1A and 1B, the capacitance loading electrode 24 is formed on the end surface 21 of the dielectric base member 10. A feeding electrode 44 is provided opposite to the capacitance loading electrode 24. Specifically, a feeding stepped-portion 47 constituted of a flat portion 45 and a protruding portion 46 is provided opposite to the capacitance loading stepped-portion 32 of the capacitance loading electrode 24.

The feeding electrode 44 is connected to a feeding terminal 48 provided on the bottom surface 15 of the dielectric base member 10. The structure of the parasitic element 17 relative to the feeding element 43 is the same as that of the first embodiment shown in FIGS. 1A and 1B.

With the electrode arrangement according to the second embodiment, high-frequency power supplied to the feeding terminal 48 is fed to the first radiation electrode 18 through the electrostatic capacitance between the capacitance loading stepped-portion 32 and the feeding stepped-portion 47. In this case, similar to the first embodiment, the electric field leaking from the portion between the capacitance loading electrode 25 and the ground electrode 27 and the portion between the capacitance loading electrode 24 and the feeding electrode 44 is reduced. Thus, the electric-field coupling between the feeding terminal 43 and the parasitic element 17 can be optimally set.

Third Embodiment

Figure 7:
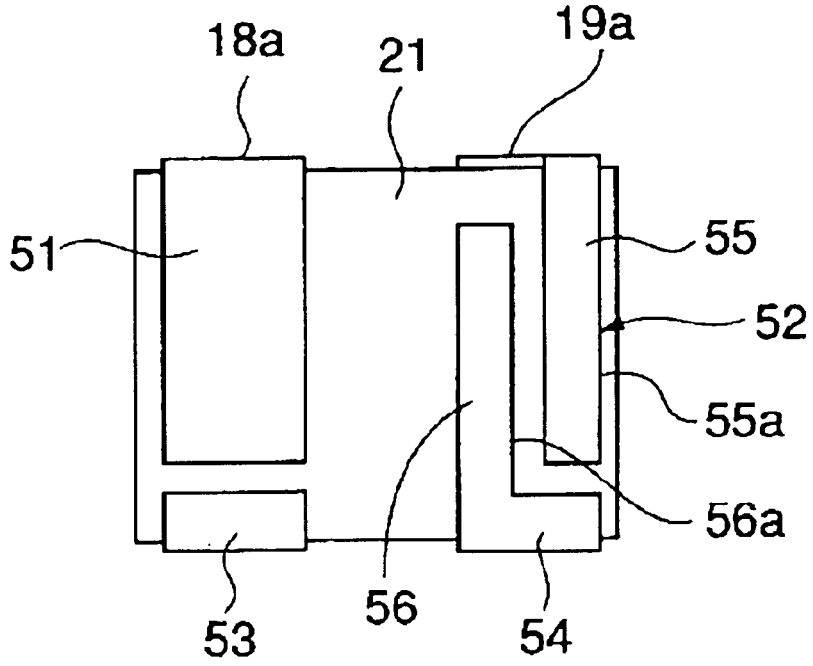
FIG. 7 is an enlarged side view showing capacitance loading electrodes and ground electrodes in a multi-resonance antenna according to a third embodiment of the present invention.

In a multi-resonance antenna according to a third embodiment of the present invention, as shown in FIG. 7, a first capacitance loading electrode 51 and a first ground electrode 53 at the feeding element side are opposed to each other, with a predetermined gap therebetween, at parallel edges thereof which are formed perpendicular to the direction in which the first radiation electrode extends. Thus, the length of the opposing edge is the same as the width of the capacitance loading electrode 51. Electric lines of force passing through the opposing portion between the capacitance loading electrode 51 and the ground electrode 53 greatly expand outside the opposing portion, and the electric field coupling with the adjacent parasitic element is strengthened. In other words, no electric-field deflector is provided at the feeding element side.

An extending portion 55 of a second capacitance loading electrode 52 at the parasitic element side is formed so as to be separated from the first capacitance loading electrode 51 as much as possible. A protruding portion 56 of a second ground electrode 54 is formed to greatly protrude upward between the first capacitance loading electrode 51 and the second capacitance loading electrode 52. With this electrode arrangement, the electric-field deflector is formed at the parasitic element side, and vertical opposing edges 55A and 56A of the extending portion 55 and the protruding portion 56 become longer than the first embodiment shown in FIGS. 1A and 1B. Thus, electrical lines of force passing through the portion between the second capacitance loading electrode 52 and the second ground electrode 54 can be enclosed between the vertical opposing edges 55A and 56A of the extending portion 55 and the protruding portion 56.

The gap between a leading edge of the protruding portion 56 of the second ground electrode 54 and an open end 19A of a second radiation electrode is formed to be larger than the gap between the vertical opposing edges 55A and 56A. Thus, electrical lines of force passing through the leading edge of the protruding portion 56 are reduced, and the electric-field coupling with the first capacitance loading electrode 51 adjacent to the leading edge portion of the protruding portion 56 is weakened. Since the electric field leaking from the opposing portion between the first capacitance loading electrode 51 and the first ground electrode 53 is mainly coupled with the second ground electrode 54, effects on the protruding portion 55 of the second capacitance loading electrode 52 and on the parasitic element can be greatly minimized.

Fourth Embodiment

Figure 8:
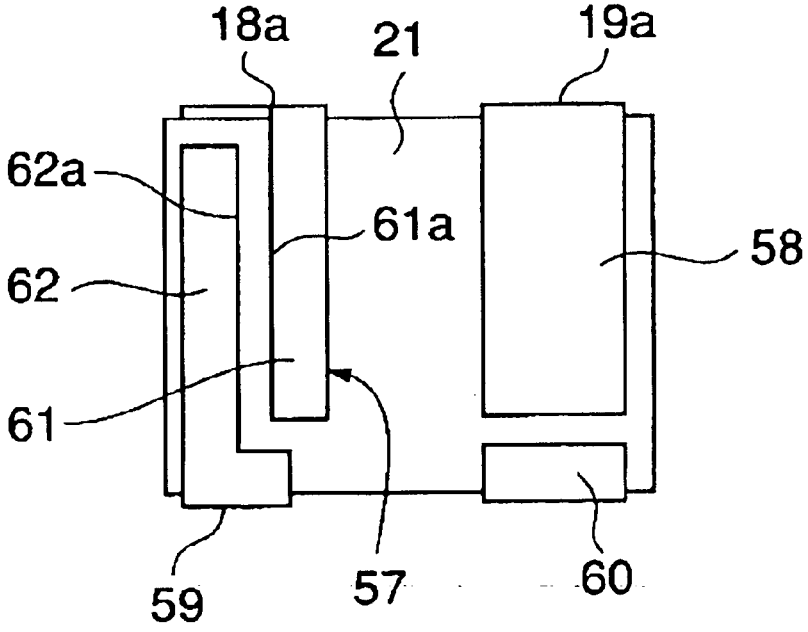
FIG. 8 is an enlarged side view showing capacitance loading electrodes and ground electrodes in a multi-resonance antenna according to a fourth embodiment of the present invention.

In a multi-resonance antenna according to a fourth embodiment of the present invention, as shown in FIG. 8, no electric-field deflector is formed at the parasitic element side. A first capacitance loading electrode 57 at the feeding element side is provided with an extending portion 61 which is formed by extending a portion of the first capacitance loading electrode 57 near a second capacitance loading electrode 58 at the parasitic element side downward. Along the extending portion 61, a protruding portion 62 is formed from a first ground electrode 59 side. Specifically, with this electrode arrangement of the electric-field deflector, similarly to the third embodiment, vertical opposing edges 61A and 62A of the extending portion 61 and the protruding portion 62 can be elongated.

In the fourth embodiment, the width of the first ground electrode 59 is narrower than the width of the second ground electrode 60. The gap between a leading edge of the first capacitance loading electrode 57 and the first ground electrode 59 is wider than the gap between the vertical opposing edges 61A and 62A. Thus, the electric field leaking from the leading edge of the extending portion 61 is weakened. In other words, the electric field is concentrated at the vertical opposing edges 61A and 62A of the first capacitance loading electrode 57 and the first ground electrode 59. Thus, the electric field leaking toward the adjacent second capacitance loading electrode 58 side can be reduced.

Fifth Embodiment

Figure 9:
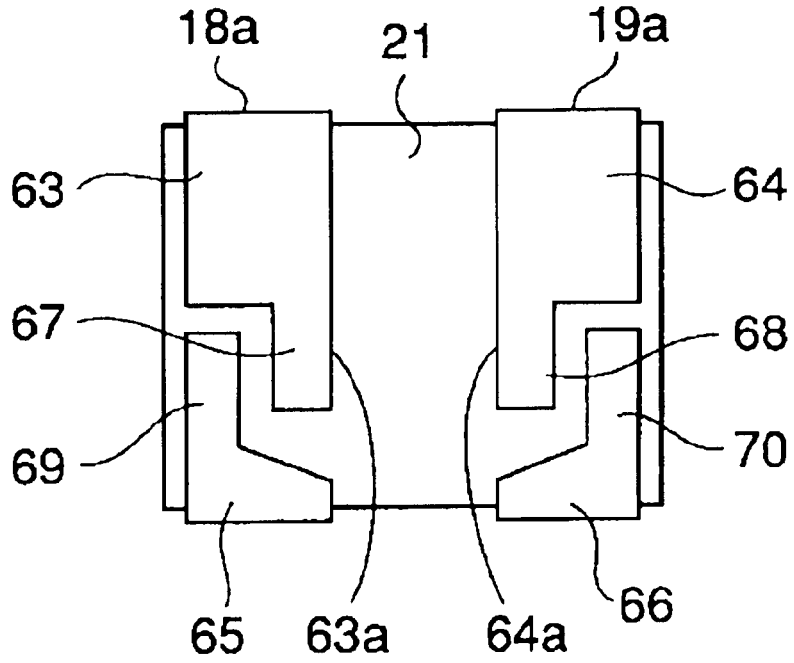
FIG. 9 is an enlarged side view showing capacitance loading electrodes and ground electrodes in a multi-resonance antenna according to a fifth embodiment of the present invention.

A multi-resonance antenna according to a fifth embodiment of the present invention, as shown in FIG. 9, is similar to the configuration of the first embodiment containing the first capacitance loading electrode 24, the second capacitance loading electrode 25, the first ground electrode 26, and the second ground electrode 27. However, at the sides where the feeding element and the parasitic element are opposed to each other, the gap between a leading edge of an extending portion 67 of a first capacitance loading electrode 63 and a first ground electrode 65 and the gap between a leading edge of an extending portion 68 of a second capacitance loading electrode 64 and a second ground electrode 66 are configured to be wider than the gaps in the other opposing portions.

When the electric-field deflectors are arranged as described above, the electric field leaking from the portions between the capacitance loading electrodes 63 and the ground electrode 65 and between the capacitance loading electrode 64 and the ground electrode 66 is increased, whereas the electric field at adjacent edges 63A and 64A of the capacitance loading electrodes 63 and 64 is weakened. In other words, portions where the electric field coupling between the capacitance loading electrodes 63 and the ground electrode 65 and between the capacitance loading electrode 64 and the ground electrode 66 is strong are deflected from the edges 63A and 64A toward the other opposing edges of the capacitance loading electrodes 63 and 64 and the ground electrodes 65 and 66. As a result, the electric-field coupling between the capacitive loading electrodes 63 and 64 is weakened, and the excessive electric field coupling between the feeding element and the parasitic element can be reduced.

Sixth Embodiment

Figure 10:
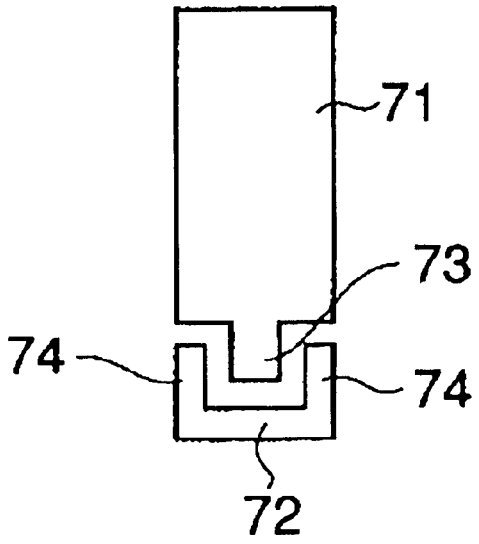
FIG. 10 is an enlarged side view of a capacitance loading electrode and a ground electrode in a multi-resonance antenna according to a sixth embodiment of the present invention.

According to a sixth embodiment of the present invention, as shown in FIG. 10, an extending portion 73 is provided at the bottom of a capacitance loading electrode 71. At the top of a ground electrode 72, protruding portions 74 extending along both edges of the extending portion 73 are provided.

When the electric-field deflector is arranged as described above, the opposing edges of the capacitance loading electrode 71 and the ground electrode 72 are elongated by the length of vertical opposing edges of the extending portion 73 and the protruding portions 74 extending in the vertical direction. Electric lines of force leaking from the opposing portion between the capacitance loading electrode 71 and the ground electrode 72 are reduced. Unlike electric lines of force in horizontal opposing edges, electric lines of force in the vertical edges are in the horizontal direction. As a result, the distribution of electric lines of force in the opposing portion between the capacitance loading electrode 71 and the ground electrode 72 can be changed.

Seventh Embodiment

Figure 11:
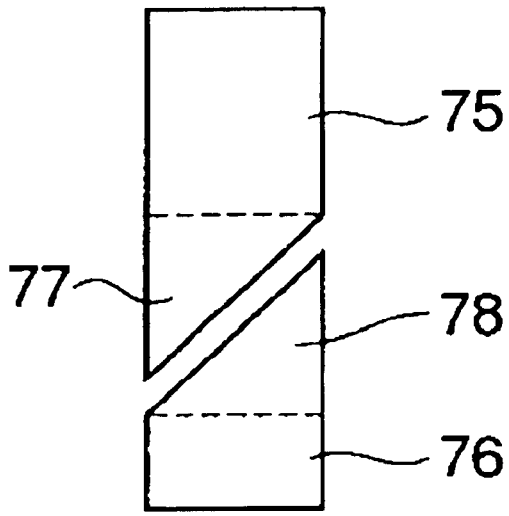
FIG. 11 is an enlarged side view of a capacitance loading electrode and a ground electrode in a multi-resonance antenna according to a seventh embodiment of the present invention.
Figure 12:
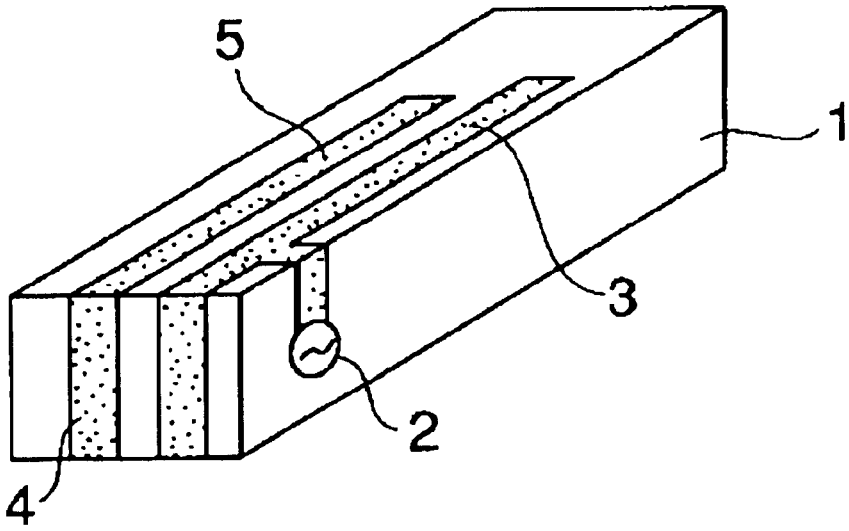
Fig.12 PRIOR ART
FIG. 12 is a perspective view of a known multi-resonance antenna.
Figure 13:
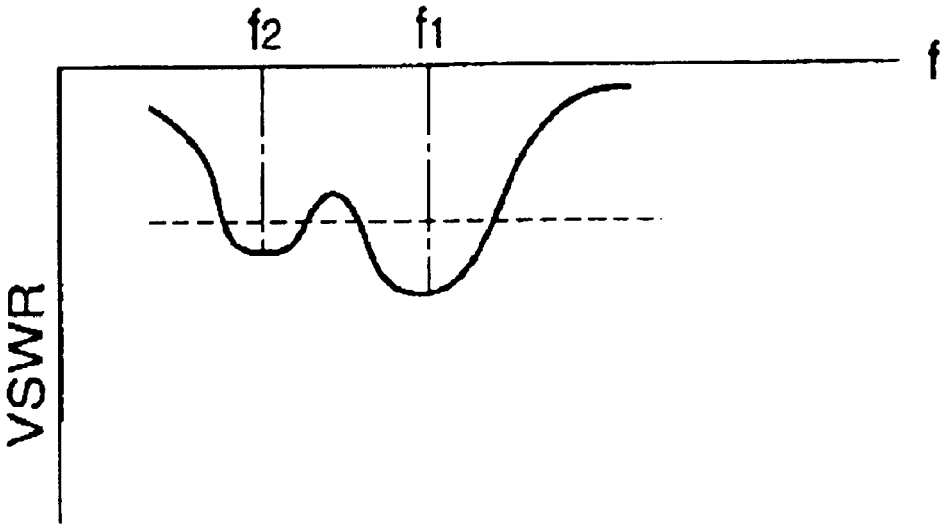
Fig.13 PRIOR ART
FIG. 13 shows VSWR characteristics for describing multi-resonance of the multi-resonance antenna.
Figure 14:
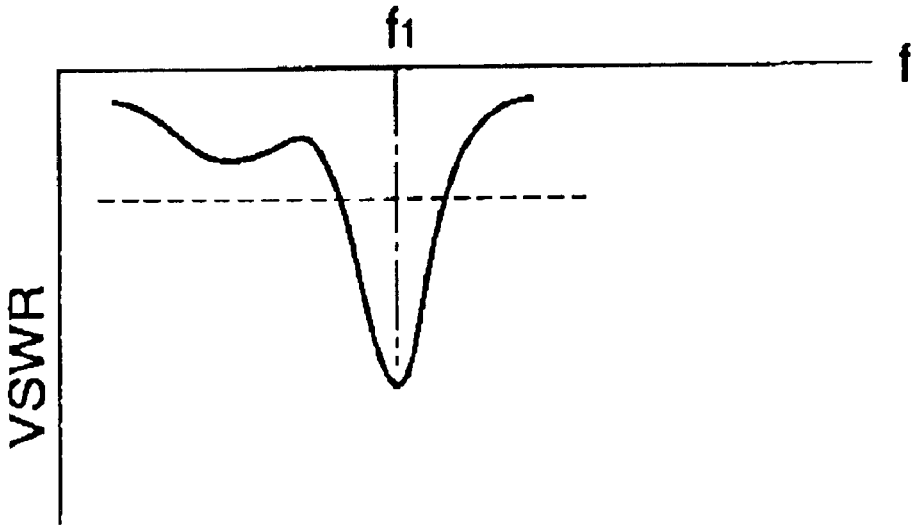
Fig.14 PRIOR ART
FIG. 14 shows VSWR characteristics for describing multi-resonance of the multi-resonance antenna.

According to a seventh embodiment of the present invention, as shown in FIG. 11, the opposing portion between a capacitance loading electrode 75 and a ground electrode 76 includes a triangular extending portion 77 and a triangular protruding portion 78, thus forming tilted opposing edges.

When the electric-field deflector is arranged as described above, the opposing edges become longer than horizontal opposing edges, and the directions of electric lines of force are tilted. When the opposing edges are tilted, the mutual interference in electric lines of force with an adjacent capacitance loading electrode is weakened.

The capacitance loading electrode described in the sixth embodiment and the seventh embodiment can be an electrode corresponding to the first capacitance loading electrode or an electrode corresponding to the second capacitance loading electrode. Also the ground electrode can be an electrode corresponding to the first ground electrode or an electrode corresponding to the second ground electrode.

In the foregoing embodiments, a single parasitic element is provided for the single feeding element 16. In the multi-resonance antenna of the present invention, a plurality of parasitic elements can be provided for the single feeding element. In this case, the electrode arrangement in the opposing portion between the capacitance loading electrode and the ground electrode and the electrode arrangement in the opposing portion between the capacitance loading electrode and the feeding electrode can be configured in accordance with the arrangement described in any of the embodiments, and multi-resonance can be adjusted between the feeding element and the plurality of parasitic elements. Concerning the width of the radiation electrode of the feeding element and the width of the radiation electrode of the parasitic element, one can be made narrower than the other, thus changing the resonance frequency.

INDUSTRIAL APPLICABILITY

The multi-resonance antenna of the present invention has optimal electric-field coupling between a feeding element and a parasitic element, and can be preferably used for linking information terminals such as cellular phones, portable mobile.

What is claimed:

1. A multi-resonance antenna comprising:

a feeding element including a first radiation electrode and a feeding electrode for feeding power to the first radiation electrode;

a parasitic element including a second radiation electrode arranged next to the first radiation electrode;

a ground electrode arranged opposite to an open end of at least one of the first radiation electrode and the second radiation electrode with a predetermined gap therebetween; and an electric-field deflector for suppressing electric-field coupling between the feeding element and the parasitic element, the electric-field deflector being disposed in a portion where said open end of said at least one of the first radiation electrode and the second radiation electrode and said ground electrode are opposed to each other.

2. A multi-resonance antenna according to claim 1, wherein the first radiation electrode and the second radiation electrode are radiation electrode strips which are arranged approximately parallel to each other.

3. A multi-resonance antenna according to claim 2, wherein the electric-field deflector substantially encloses an electric field generated between the open end of said at least one of the first radiation electrode and the second radiation electrode and the ground electrode and deflects the direction of an electric field vector from the direction in which the first radiation electrode and the second radiation electrode extend.

4. A multi-resonance antenna according to claim 2, wherein the open end of the radiation electrode and the ground electrode have opposing edges which are not perpendicular to the direction in which the first radiation electrode and the second radiation electrode extend.

5. A multi-resonance antenna according in claim 1, wherein capacitance. loading electrode is provided at the open end of the radiation electrode, and the electric-field deflector is defined by the capacitance loading electrode and the ground electrode.

6. A multi-resonance antenna according to claim 5, wherein the capacitance loading electrode includes first and second capacitance loading electrode, the first capacitance loading electrode and the second capacitance loading electrode are disposed at the open end of the first radiation electrode and the open end of the second radiation electrode, respectively.

7. A multi-resonance antenna according to claim 6, wherein the ground electrode includes first and second ground electrodes, the first ground electrode is disposed opposite to the first capacitance loading electrode with a predetermined gap therebetween, and the second ground electrode is disposed opposite to the second capacitance loading electrode with a predetermined gap therebetween.

8. A multi-resonance antenna according to claim 7, wherein the electric-field deflector is disposed between the first capacitance loading electrode and the first ground electrode and another electric-field deflector is disposed between the second capacitance loading electrode and the second ground electrode.

9. A multi-resonance antenna according to claim 8, further comprising a substantially-rectangular dielectric base member, wherein the first radiation electrode and the second radiation electrode have a strip-shaped configuration and are substantially parallel to each other on a first major surface of the substantially-rectangular dielectric base member, and the first capacitance loading electrode and the second capacitance loading electrode are disposed on an end surface adjacent to the first major surface of the dielectric base member.

10. A multi-resonance antenna according to claim 9, wherein the first ground electrode and the second ground electrode are disposed on the end surface of the dielectric base member, and the electric-field deflector is disposed on the end surface of the dielectric base member.

11. A multi-resonance antenna according to claim 1, wherein the ground electrode is a first ground electrode and is arranged opposite to the open end of the first radiation electrode with a predetermined gap therebetween and a second ground electrode is arranged opposite to the open end of the first radiation electrode with a predetermined gap therebetween.

12. A multi-resonance antenna according to claim 11, wherein the electric-field deflector is disposed in the portion between the open end of the first radiation electrode and the first ground electrode and another electric-field deflector is disposed in the portion between the open end of the second radiation electrode and the second ground electrode.

13. A multi-resonance antenna comprising:

a dielectric base member;

a first radiation electrode and a second radiation electrode including strips arranged substantially parallel to each other on a major surface of the dielectric base member;

a feeding electrode for feeding power to the first radiation electrode;

a ground electrode for grounding the second radiation electrode;

first and second capacitance loading electrodes disposed at open ends of the first and second radiation electrodes, respectively;

a ground electrode arranged opposite to at least one of the first and second capacitance loading electrodes;

wherein said at least one of the first and second capacitance loading electrodes and the ground electrode are provided with protruding electrodes which extend in opposite directions in a portion where said at least one of the first and second capacitance loading electrodes and the ground electrode are opposed to each other.

14. A multi-resonance antenna according to claim 13, wherein the first and second capacitance loading electrodes are aligned each other.

15. A multi-resonance antenna according to claim 14, wherein the protruding electrode of said at least one of the first and second capacitance loading electrodes and the protruding electrode of the ground electrode have opposing edges which extend in a direction that is different from the direction in which the first and second capacitance loading electrodes are aligned.

* * * * *

UNITED STATES PATENT AND TRADEMARK OFFICE

CERTIFICATE OF CORRECTION

PATENT NO. : 6,784,843 B2
APPLICATION NO. : 10/257878
DATED : August 31, 2004
INVENTOR(S) : Onaka et al.

It is certified that error appears in the above-identified patent and that said Letters Patent is hereby corrected as shown below:

On The Title Page: Item (22) PCT Filed: Feb. 18, ~~2001~~ 2002

(30) Foreign Application Priority Data
Feb. 22, ~~2000~~ 2001 (JP).....2001-046956

Signed and Sealed this

Thirteenth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 6,784,843 B2
APPLICATION NO. : 10/257878
DATED : August 31, 2004
INVENTOR(S) : Onaka et al.

It is certified that error appears in the above-identified patent and that said Letters Patent is hereby corrected as shown below:

On The Title Page: Item (22) should read

--(22) PCT Filed: Feb. 18, ~~2001~~ 2002--

Item (30) should read

--(30) Foreign Application Priority Data
Feb. 22, ~~2000~~ 2001 (JP).....2001-046956--

Signed and Sealed this

Twenty-seventh Day of March, 2007

JON W. DUDAS
*Director of the United States Patent and Trademark Office*